US006388622B1

(12) United States Patent
Jennetti et al.

(10) Patent No.: US 6,388,622 B1
(45) Date of Patent: May 14, 2002

(54) POLE ANTENNA WITH MULTIPLE ARRAY SEGMENTS

(75) Inventors: Anthony G. Jennetti, Sunnyvale; James D. Budack, Santa Clara; Ralph A. Belingheri, Woodside; Greg A. Manassero, San Jose, all of CA (US)

(73) Assignee: TRW Inc., Redondo Beach, CA (US)

( * ) Notice: Subject to any disclaimer, the term of this patent is extended or adjusted under 35 U.S.C. 154(b) by 0 days.

(21) Appl. No.: 09/759,761

(22) Filed: Jan. 11, 2001

(51) Int. Cl.[7] ..... H01Q 1/38

(52) U.S. Cl. ..... 343/700 MS; 343/872; 343/853

(58) Field of Search ..... 343/700 MS, 872, 343/890, 892, 891, 893, 853; H01Q 1/38

(56) References Cited

U.S. PATENT DOCUMENTS 5,757,324 A * 5/1998 Helms et al. ..... 343/700 MS
5,912,646 A * 6/1999 Seki et al. ..... 343/700 MS
5,923,296 A * 7/1999 Sanzgiri et al. ..... 343/700 MS
6,040,802 A * 3/2000 Smith et al. ..... 343/700 MS

* cited by examiner

*Primary Examiner*—Hoanganh Le
(74) *Attorney, Agent, or Firm*—Noel F. Heal

(57) ABSTRACT

A three-array pole antenna highly suited for use in a communication system, and mounted in a cylindrical cover that may be supported atop a conventional pole of similar diameter. The antenna includes a ground plane structure (26) with three outwardly facing facets (28) that are joined together to form a rigid structure. Three antenna feed printed circuit boards (14) each provide two antenna feeds to an array of antenna patches (16) that are electromagnetically coupled to the circuit boards. Metal-to-metal connections are limited to radio-frequency (RF) feed connectors to the circuit boards (24), to minimize intermodulation effects. The entire antenna structure is of low cost and is easy to assemble and install.

10 Claims, 7 Drawing Sheets

POLE ANTENNA WITH MULTIPLE ARRAY SEGMENTS

BACKGROUND OF THE INVENTION

This invention relates generally to antennas and, more particularly, to high frequency antenna arrays of the type used in communication systems, such as cellular telephone systems. In cellular systems, portable telephones communicate with nearby base stations, which are themselves interconnected by land lines or other means. Each base station antenna has to have the ability to communicate with multiple portable telephones located in a geographic "cell" over which the base station provides coverage. Therefore, the base station antenna must have a radiation pattern extending over a full 360° of azimuth angle. Typically, a base station antenna has three equal arrays that are angularly spaced 120° apart, with the radiation patterns overlapping slightly to provide the required full-circle coverage.

Although the technology of such antennas is now well established, some significant difficulties have emerged concerning their placement and operation, particularly in urban and suburban areas. The antennas must be placed about fifty feet above ground and, for optimum operation, they must be visible over a direct line of sight from each telephone user. Unfortunately, conventional base station antennas do not have an attractive appearance. Also, because the antenna arrays consist of multiple horizontal elements, they provide a convenient perching place for birds, which are exposed to intense high-frequency radiation. Many communities, although wanting to maintain cellular coverage, have sought ways to hide or disguise the appearance of base station antennas. One approach is to locate the antennas in trees, or even to construct the antennas to look like trees. Whether these approaches help make the antennas less of an eyesore is still debatable. Without question, even the disguised antennas remain an attractive nuisance for birds and other small animals.

A significant design difficulty with antennas of this general type arises from the difficulty of constructing an antenna array without employing a number of metal-to-metal junctions with dissimilar metals. Over time, corrosion at such junctions may result in electrochemically induced intermodulation. In essence, a degraded metal-to-metal junction may act as a diode in the antenna structure and produce unwanted signal components that degrade antenna performance. Therefore, it is highly desirable to eliminate or minimize metal-to-metal junctions in the antenna construction. Another important issue is antenna cost. With the continuing proliferation of cellular and similar communication systems, more and more base stations antennas are needed, and constructing them at a competitive cost has become increasingly important.

Accordingly, there is a need for a base station antenna array that meets stringent engineering requirements, as well as aesthetic cost requirements. The present invention satisfies this need.

BRIEF SUMMARY OF THE INVENTION

The present invention resides in a multiple-array antenna that can be mounted inside a pole. Briefly, and in general terms, the invention may be defined as a radio-frequency (RF) pole antenna with multiple arrays, the antenna comprising a ground plane structure, a plurality of antenna feed circuit boards, a plurality of arrays of antenna patches, a plurality of pairs of RF feed connectors, and a cylindrical cover for the antenna.

More specifically, the ground plane structure has a plurality (n) of structurally and electrically connected facets directed in uniformly spaced angular directions and there is a plurality (n) of antenna feed printed circuit boards. Each of the antenna feed printed circuit boards is attached to, but spaced apart from, one of the ground plane facets, and each antenna feed printed circuit board has two feed points and two symmetrical circuit paths for feeding RF signals of different polarizations. Each of the circuit paths has divergent branches leading to a plurality (m) of antenna patch drive segments. Each array of antenna patches is distributed along one of the antenna feed printed circuit boards and is mounted to provide electromagnetic coupling between each antenna patch and an associated pair of antenna feed patch drive segments, one from each circuit path in the antenna feed printed circuit board. Each antenna patch is coupled simultaneously to its associated pair of antenna feed patch drive segments, and each antenna patch includes a drive element electromagnetically coupled to its associated pair of antenna feed patch drive segments, and at least one parasitic element mounted in a spaced relationship with the drive element. Each pair of RF feed connectors provides electromagnetic coupling with respective feed points on one of the antenna feed printed circuit boards, and provides connection to RF transmitting and receiving circuitry that employ the pole antenna. The cylindrical cover encloses the entire antenna, and renders the entire assembly highly suited for mounting on a support pole of similar diameter to that of the cover.

An important aspect of the invention is that each antenna array, formed by the ground plane structure, one of the antenna feed printed circuit boards, one of the arrays of antenna patches, and one of the pairs of RF feed connectors, has metal-to-metal connection only in the pair of RF feed connectors. This minimizes intermodulation effects on antenna performance. Further reduction in intermodulation effects is obtained as a result of assembling the ground plane structure using a dimple welding process.

In the disclosed embodiment of the invention, the number (n) of antenna arrays and ground plane facets is three, and each antenna patch has two parasitic elements, including a first parasitic element mounted in a parallel spaced relationship with the drive element, and a second parasitic element mounted in a parallel spaced relationship with the first parasitic element. Specifically, the drive element in each antenna patch is a flat plate of generally octagonal shape. The first parasitic element in each antenna patch is a flat plate of irregular shape having four extending arms and diagonally slanting edges between the arms, and the second parasitic element in each antenna patch is a flat plate having an approximately square shape with diagonally cutoff corners.

In the illustrated embodiment of the invention, each array of antenna patches is driven simultaneously in two different polarization modes to provide polarization diversity gain. In particular, each array of antenna patches is driven simultaneously in linear polarization modes at +45° and −45° with respect to a vertical axis of the pole antenna.

It will be appreciated from the foregoing that the present invention represents a significant improvement over prior antennas of the same general type. In particular, the pole antenna of the present invention provides electrical performance equal to or exceeding that of competitive antennas, but is accommodated in a relatively small-diameter cylindrical cover that is mountable on a support pole of similar diameter. The pole antenna has good azimuth and elevation coverage, and low intermodulation effects, which result from the minimization of metal-to-metal joints. Other aspects and advantages of the invention will be apparent from the following more detailed description, taken in conjunction with the accompanying drawings.

DETAILED DESCRIPTION OF THE INVENTION

Figure 1:
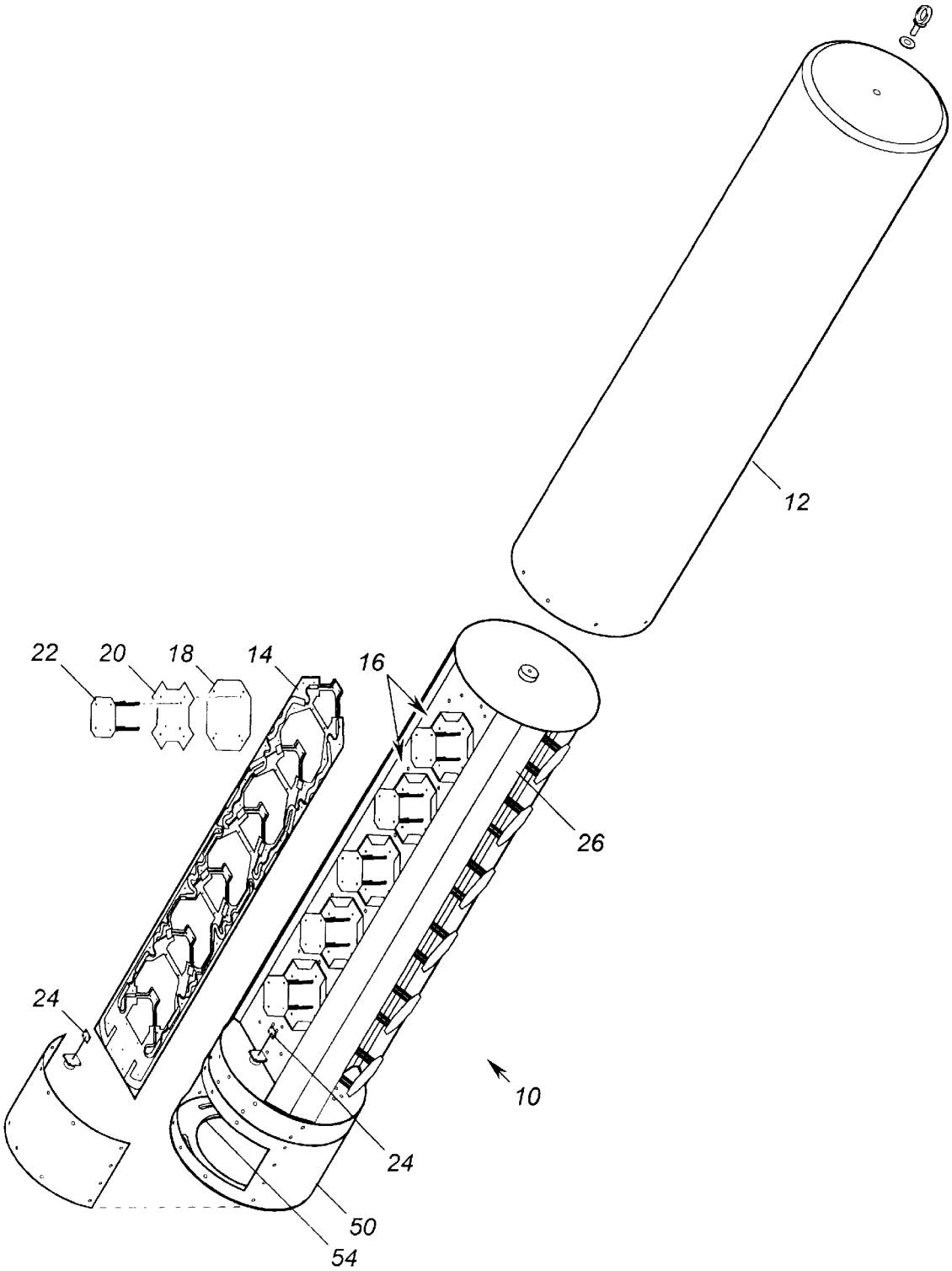
FIG. 1 is an exploded perspective view of a pole antenna constructed in accordance with the invention.

As shown in the drawings for purposes of illustration, the present invention pertains to a triple-array antenna mountable inside a pole to obviate many of the aesthetic objections to conventional array antennas used in base stations for cellular telephone systems. Conventional base station antenna arrays typically comprise arrays or elements in the form of metal rods, which present an unpleasant appearance and also provide an attractive nuisance for bird and other animal life.

In accordance with the present invention, a base station antenna array, or more precisely multiple arrays, are housed inside a pole structure of relative small diameter. In the disclosed embodiment, the diameter of the pole is approximately 16 inches (407 mm). As best shown in FIG. 1, the antenna of the invention, indicated generally by reference numeral 10, is completely housed inside a cylindrical radome cover 12, which is shown removed to expose the antenna components. As will be described in more detail with reference to other figures, the antenna 10 has three arrays positioned to provide coverage in three sectors that are angularly separated by 120° in azimuth angle. Only one of the arrays is visible in FIG. 1. Each array comprises an antenna feed printed circuit board 14 and six antenna patches, five of which are shown at 16, mechanically attached and electromagnetically coupled to the antenna feed printed circuit board 14. As will also be described in more detail below, each antenna patch 16 includes an active element 18 of approximately octagonal shape, which will be referred to as the bottom element, an irregularly shaped first parasitic element 20 mounted in a parallel, spaced relationship with the active element and referred to as the middle element, and a second parasitic element 22 mounted in a parallel, spaced relationship with the middle element and referred to as the top element. The top element is also of approximately octagonal shape. The antenna patches 16 are fed from conductive traces on the antenna feed printed circuit board 14, in a manner that will become clear as more details are described. Connections to the antenna 10 are made through radio-frequency (RF) connectors located near the bottom edge of the circuit board 14, one of the RF connectors being shown at 24. Each of the three sectors of the antenna 10 has two connectors 24, to drive the antenna simultaneously in two linear polarization modes at +45° and −45° to the vertical axis of the pole antenna.

Figure 2:
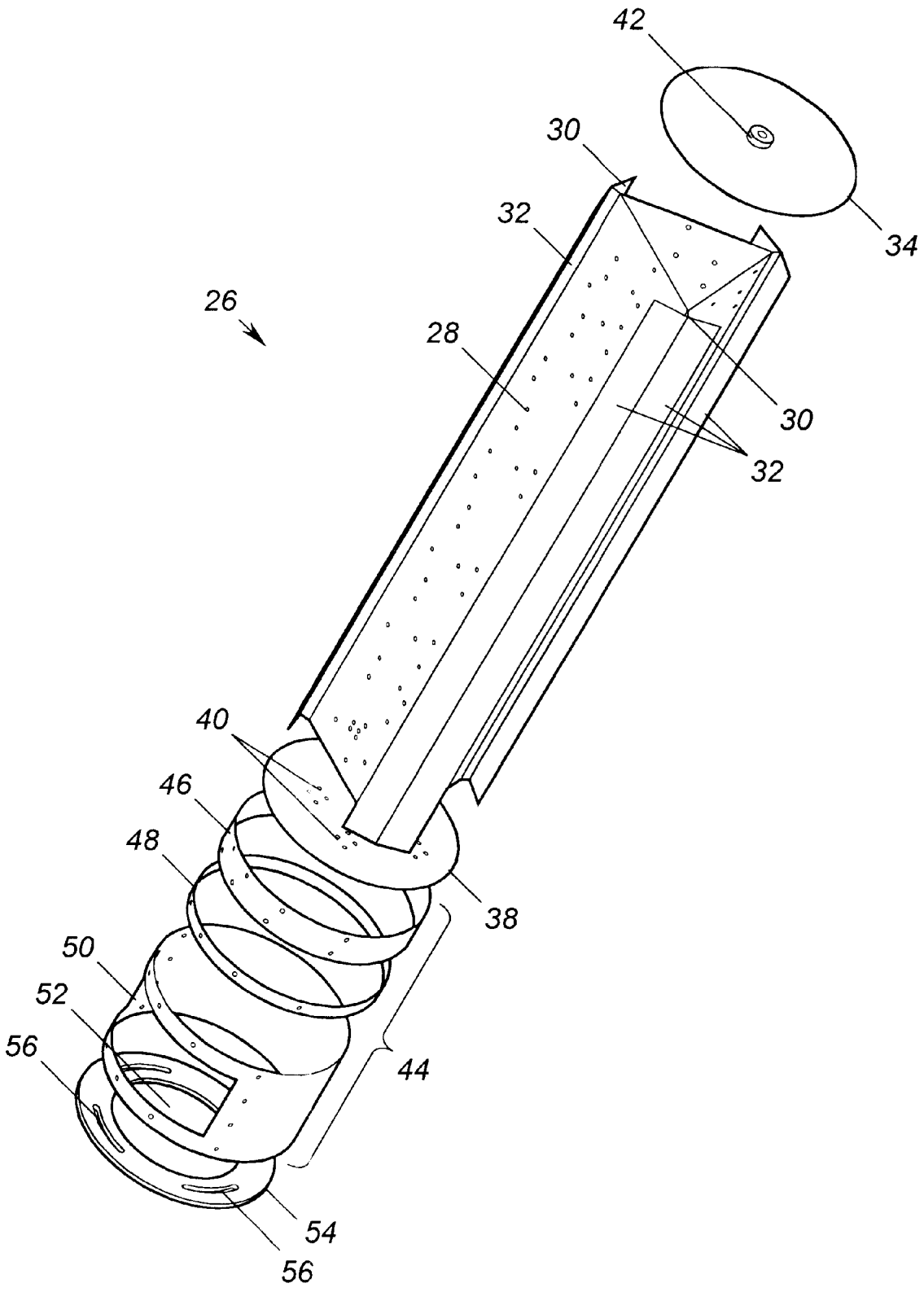
FIG. 2 is an exploded perspective view of a ground plane structure and cylindrical base of the pole antenna shown in FIG. 1.

The antenna 10 has a ground plane indicated generally at 26 in FIG. 1 and shown in more detail in FIG. 2. Like the antenna 10 itself, the ground plane 26 has three identical segments. The principal operative part of each ground plane segment is a flat, rectangular plate 28 on which is mounted the antenna feed circuit board 14. The rectangular plate 28 has two parallel long edge portions that are parallel with the axis of the antenna pole. Each of these edge portions adjoins an integral flange 30 formed by bending the plate 28 through approximately 30°. The flange 30 adjoins another integral flange 32, formed by bending the plate material through an additional angle of approximately 120°. The ground plane structure 26 is assembled by placing the rectangular plates 28 with their adjacent long edges together, as shown in FIG. 2. The shorter edges of the rectangular plates 28 form an equilateral triangle when viewed from the top or bottom of the ground plane structure 26, and the flanges 30 of adjacent segments of the structure are secured together by a welding process to be described below. The outer flanges 32 of each segment of the ground plane structure 26 extend toward each other over the rectangular plate 28.

The ground plane structure 26 further includes a circular top plate 34 that engages the upper short edges of the rectangular plates 28. The ground plane structure 26 further includes a circular bottom plate 38 having slots 40 formed through it to receive the antenna feed connectors 24. A central post (not shown) extends through the ground plane structure, and is secured to the three rectangular plates 28. A central threaded boss 42 on the top plate 34 is preferably also secured to the central post. A cylindrical base 44 to which the ground plane structure 26 is secured includes an upper ring 46, a lower ring 48 and a base cylinder 50 having an access window 52 for connecting RF antenna feeds to the connectors 24. A lower annular ring 54 with arcuate slots 56 is used to couple the antenna 10 to the top of a pole (not shown), usually of the same diameter as the cover 12 of the antenna structure.

Figure 3:
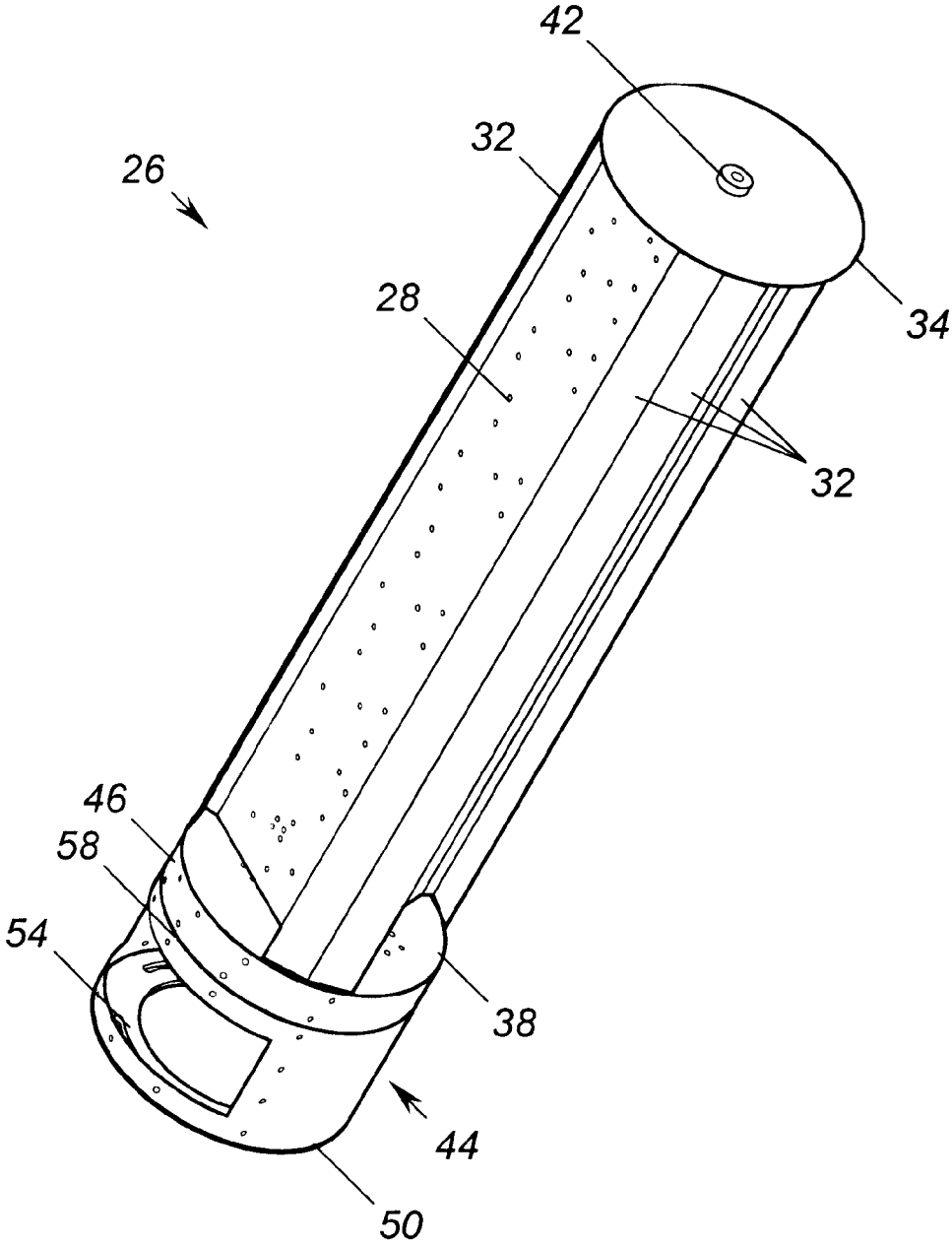
FIG. 3 is a perspective view similar to FIG. 2 but showing the ground plane structure and cylindrical base after assembly.

FIG. 3 shows the ground plane structure 26 and cylindrical base 44 components assembled. The base cylinder 50 is secured to the upper ring 46 by welding and is of slightly larger diameter than the upper ring. Thus, the upper edge of the base cylinder 50 forms an annular shoulder 58, and the outer cover 12 of the antenna 10 fits over the upper ring 46 and abuts this annular shoulder.

Figure 4:
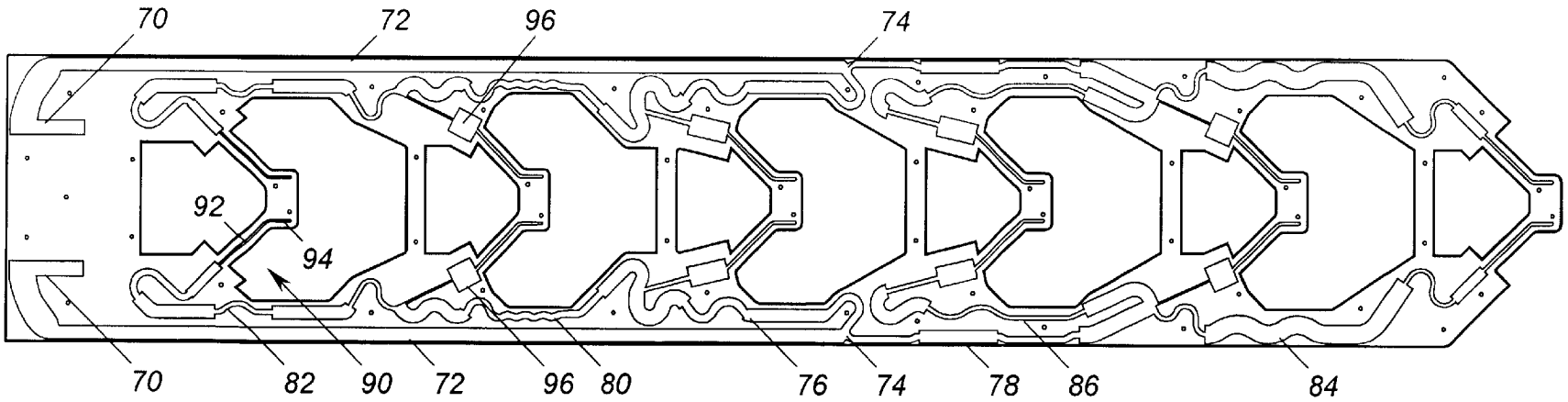
FIG. 4 is a plan view of an antenna feed printed circuit board as employed to feed each of three segments of the pole antenna.
Figure 5:
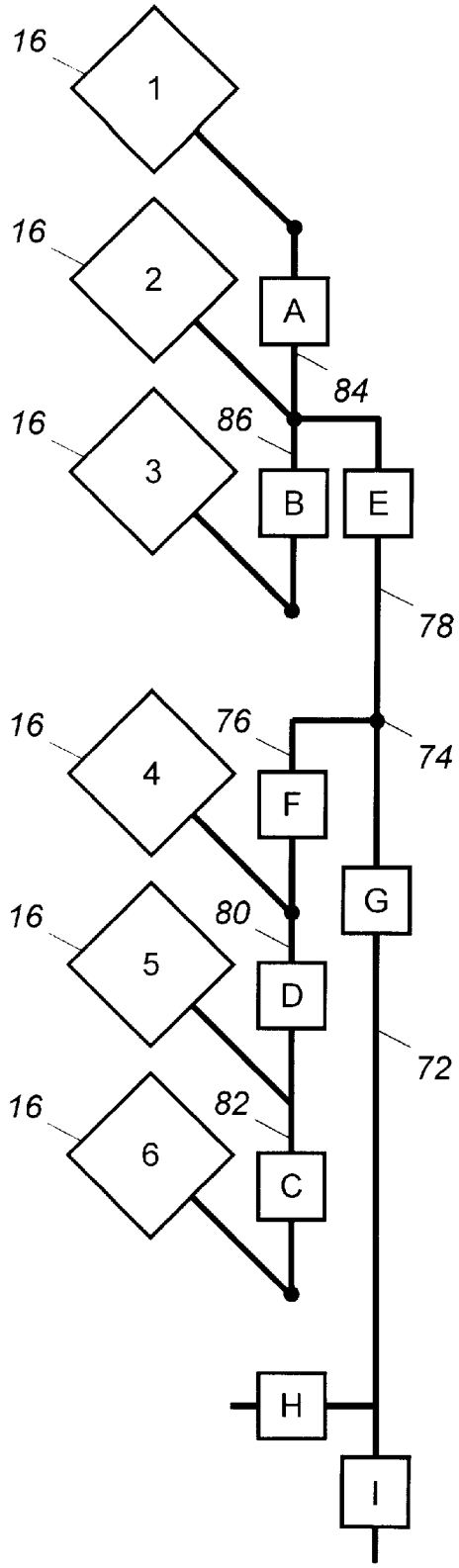
FIG. 5 is a simplified circuit diagram showing how the printed circuit board of FIG. 4 establishes antenna feed connections with six antenna patches included in each of the three segments of the pole antenna.

FIG. 4 depicts the layout of conductive traces and other components on each of the antenna feed circuit boards 14. Because of the relatively large size of this board in the presently preferred embodiment, 10.88 inches by 65 inches (27.6 cm by 165.1 cm), fabrication in two or more sections may be necessary. The board 14 is illustrated as a single structure in FIG. 4, but it will be understood that segmentation of the board may be necessary, depending on the circuit board fabrication capability available at the time of manufacture. It will be noted that the traces and other components on the board 14 are symmetrical about the longitudinal axis of the board. Two feed points 70, in the form of straight conductive traces on the circuit board, are positioned at the bottom end portion of the board, and conductive strips 72 extend from these feed points along opposite edge portions of the board. The two paths carry RF signals in different linear polarization modes, at angles of +45° and −45° to the vertical axis. FIG. 5 shows diagrammatically how these signals in each path are split for feeding to the six antenna patches 16. The feed configuration is referred to as a semicorporate feed. The main path 72 is split at a junction point 74 into a lower path 76 that extends to the lower three antenna patches 16 and an upper path 78 that extends to the upper three antenna patches. The lower path 76 extends first to the third antenna patch 16 (from the bottom); then a further path 80 extends to the second antenna patch, and from there a further path 82 extends to the bottom antenna patch. The upper path 78 extends first to the middle of the top three antenna patches, and further paths 84 and 86 extend to the upper and lower antenna patches of the top three patches. Counterparts of these paths can be identified in FIG. 4. It will be observed, however, that the paths shown in FIG. 5 as extending to antenna patches 16, terminate in FIG. 4 as bent "dog-leg" traces 90, each having a first segment 92 oriented at 45° to the vertical direction and an adjoining shorter segment 94 oriented vertically. An antenna patch structure 16 is positioned in an electromagnetically coupled relationship with the each pair of traces 90. In particular, the drive element 18 is secured in a parallel relationship with the circuit board 14, such that the traces 90 couple to the drive element.

The conductive traces on the circuit board 14 follow meandering paths having lengths selected to ensure that the antenna patches 16 are driven in a desired phase relationship, i.e., that signals transmitted from all six patches are in phase with each other. Therefore, the phase delays between the junction point 74 and the respective patches 16 are all the same. For example, the phase delay over paths 76 and 78, designated E and F in FIG. 5, are both close to one wavelength at the known operating frequency, and the phase delays over paths 84, 86, 80 and 82, designated A, B, C and D, respectively, in FIG. 5, are all one wavelength. Paths leading to traces 90 that couple to the antenna patches 16 also include wider pads, such as 96, which effect impedance matching between the connecting paths and the patch coupling segments. The signals paths on the board 14 are also designed to split power in a desired manner among the antenna patches 16. For example, the path impedances at the junction point 74 "looking" along path segments 76 and 78, are designed to be equal, to ensure equal power distribution to the upper and lower sets of three antenna patches 16.

The conductive traces on each printed circuit board 14 are used in a configuration known as inverted microstrip. The circuit board 14 is installed with the conductive traces facing the rectangular plate 28 of the ground plane structure 26. The circuit board 14 is attached to the plate 28 by conventional stand-off snap connectors, which suspend the circuit board at a distance of about one-eighth of an inch (approximately 3 mm). Therefore, each conductive strip is separated from the ground plane 26 by an air gap between the plate 28 of the ground plane and the circuit board 14. A conventional microstrip structure has the conductive trace separated from a ground plane by a dielectric material, which potentially results in signal losses and degraded performance.

Figure 6:
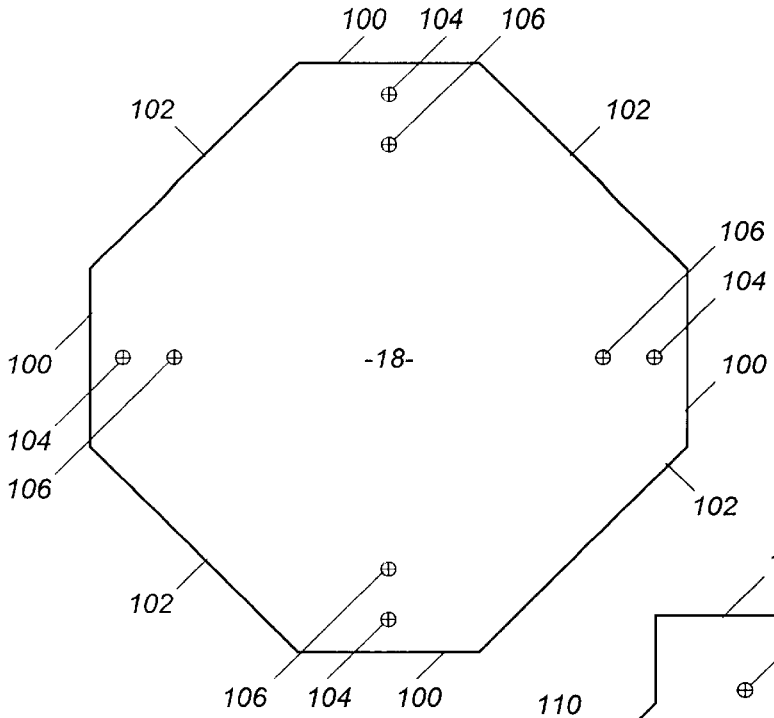
FIG. 6 is a plan view of a bottom or driven element of one of the antenna patches.

FIG. 6 depicts the bottom element 18 of one of the antenna patches 16. The bottom element 18 is formed from sheet metal, such as a suitable aluminum alloy, approximately 0.06 inch (1.5 mm) in thickness and is only approximately octagonal, since it has four equal shorter edges 100 aligned in horizontal and vertical directions with respect to the antenna pole axis, and four equal longer diagonal edges 102 aligned at 45° to the antenna pole axis. This bottom element 18 also has a set of four through holes 104 near the periphery of the element, used for attaching stand-off snap connectors (not shown) to attach the bottom element to the ground plane plate 28, such that the element 18 is in close electromagnetic coupling relationship with one set of antenna feed elements 90. The bottom element 18 also has another set of through holes 106 located adjacent to and inward of the respective holes 104. The second set of holes 106 is used to attach additional stand-off snap connectors (not shown) for attachment of the middle element 20 of the antenna patch 16.

Figure 7:
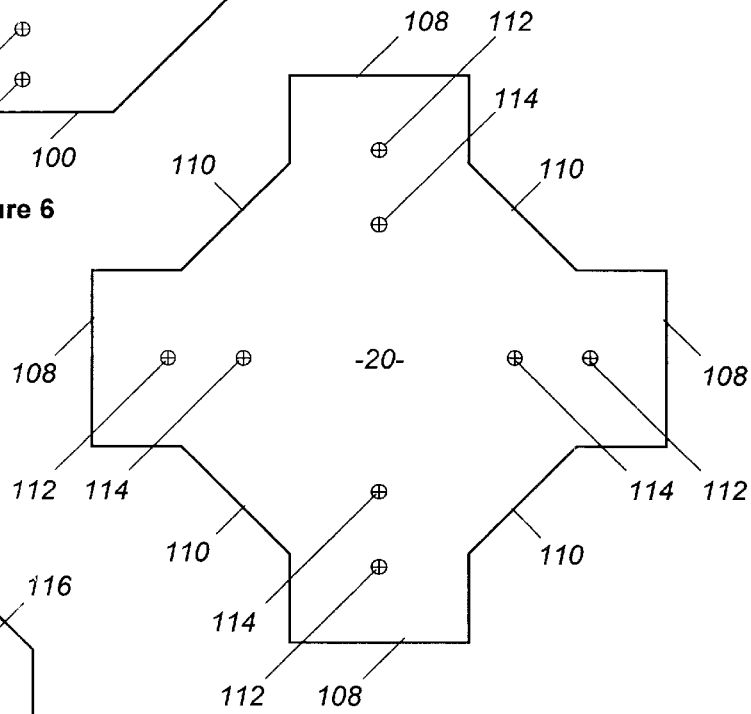
FIG. 7 is a plan view of a middle parasitic element of one of the antenna patches.

FIG. 7 depicts the middle element 20 of one of the antenna patches 16. The middle element 20 is formed from the same sheet metal and the same thickness as the bottom element 18 has an irregular shape that is best characterized as approximating a symmetrical cross or "plus" sign, with four arms 108 at right angles to each other, and having four diagonal edges 110 extending at 45° between adjacent arms. A set of four holes 112 centrally located near the end of each arm 108 are used to attach the same stand-off connectors that attach to holes 106 in the bottom patch element 18, to attach the middle element in a parallel and spaced relationship with the bottom element. A second set of holes 114 are used to attach additional stand-off snap connectors for attaching the top element 22 of the antenna patch 16.

Figure 8:
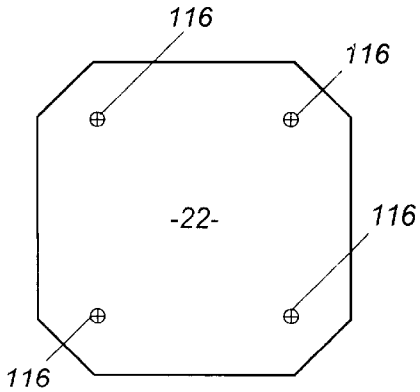
FIG. 8 is a plan view of a top parasitic element of one of the antenna patches.

FIG. 8 shows the top element of the antenna patch 16, which is also of the same material as the middle element 20 and the bottom element 18, but with a slightly smaller thickness of approximately 0.04 inch (1 mm). The top element is eight-sided but is probably more accurately described as having a square shape with corners cut off at a 45° angle. The top element 22 has a set of four holes 116 near the cutoff corners of the element, the holes corresponding in position to the holes 114 in the middle element 20. The top element 22 is attached to the middle element 20 using conventional stand-off connectors that are fitted into the holes 114 and 116.

Figure 9:
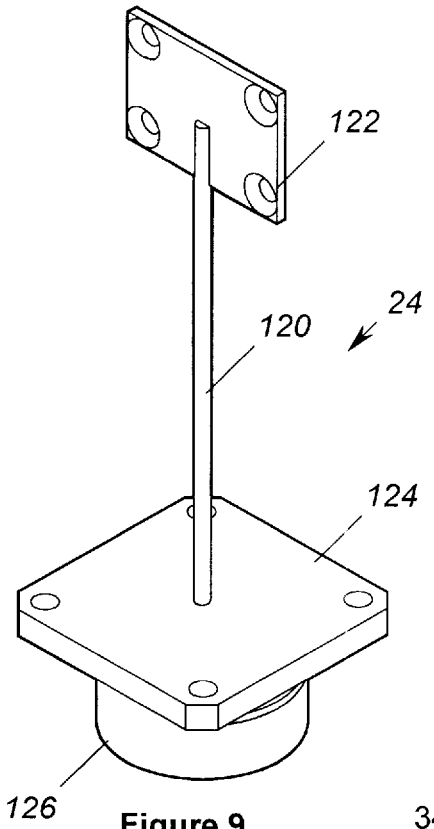
FIG. 9 is perspective view of a radio-frequency (RF) antenna connector, of which six are employed in the illustrated pole antenna of the invention.

FIG. 9 shows one of the RF connectors 24 in more detail. The connector 24 includes a connector rod 120, which, when the connector is installed, extends through one of the slots 40 in the bottom plate 38 of the ground plane structure 26. One end portion of the rod 120 is flattened on one side, to facilitate soldering to one face of a generally square-shaped plate 122. The plate 122 has four holes to accommodate four screws, nuts, and washers (not shown) that attach it firmly and under pressure to the ground plane 28. Each connector rod 120 and one of the straight circuit board traces 70 form an electromagnetic coupling relationship enabling coupling of the RF signal between the printed circuit board 14 and the connector rod. The lower end of the rod 120 terminates in a connector flange 124 and a conventional female coaxial connector 126, such as a DIN 7/16inch connector. The RF connectors 24 also serve as lightning protection devices for the antenna. The joint between the plate 122 and the ground plane 28 provides a broad contacting area that minimizes intermodulation generation. The principle of using a broad contact area and applied pressure to minimize intermodulation generation is known to those skilled in the antenna art. Application of this principle minimizes the chance of intermodulation generation should corrosion occur over the lifetime of the antenna. Protective coatings are applied in the nearby vicinity of the junction of the plate 122 and the ground plane 28 to seal the metal junction and to protect against corrosion. The antenna is enclosed in the radome 12 to protect the antenna from corrosive environmental elements.

The rod 120 is a quarter of a wavelength long. For RF signals the rod 120 functions as quarter wavelength choke. Any static electricity and direct-current signals are grounded through the plate 122, but RF energy is coupled electromagnetically from the rod 120 to the trace 70 on the printed circuit board 14.

Figure 10:
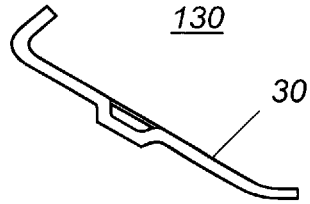
FIG. 10 is a fragmentary cross-sectional view showing a dimple used for welding construction of the ground plane structure.

An important aspect of the invention is that intermodulation is kept to a minimum because the antenna has only one metal joint in each antenna circuit, in the RF connectors 24. RF signals are electromagnetically coupled to the antenna feed printed circuit board 14, and from the printed circuit board to the antenna patches 16. The ground plane structure 26 is assembled without rivets, which also helps minimize intermodulation effects. Specifically, the ground plane structure 26 is assembled using a dimple welding process that minimizes metal-to-metal contact and further reduces the risk of intermodulation effects. FIG. 10 shows an enlarged section of one of the flanges 30 of the ground plane structure. As described with reference to FIG. 2, flanges 30 of adjacent ground plane plates 28 are secured together by welding. Specifically, one of two flanges 30 to be joined by welding is pre-formed to include a number of dimples or indentations, one of which is shown at 130. Each dimple 130 projects above the surface of the flange 30 by approximately 0.060 inch (1.5 mm). A conventional spot welding process joins the flanges 30 at the locations of the dimples 130, but not at other locations. Thus the components of the ground plane structure are securely connected both mechanically and electrically by the welded dimples, but the number metal-to-metal contacts is limited and the possibility of intermodulation effects is minimized.

The illustrated embodiment of the invention has been designed to transmit and receive in a frequency range of 806–866 MHz. It will be understood, of course, that the invention is not limited to a particular frequency range of operation. The antenna in this embodiment has also been designed to operate simultaneously employing signals at two linear polarization angles at +45° and −45° with respect to the vertical axis of the pole antenna. Polarization diversity gain is known to result in significantly lower bit error rates in the transmission of digital data, but it will be appreciated that polarization diversity could also be obtained using other combinations of polarized signals, such horizontal and vertical polarization.

Figure 11:
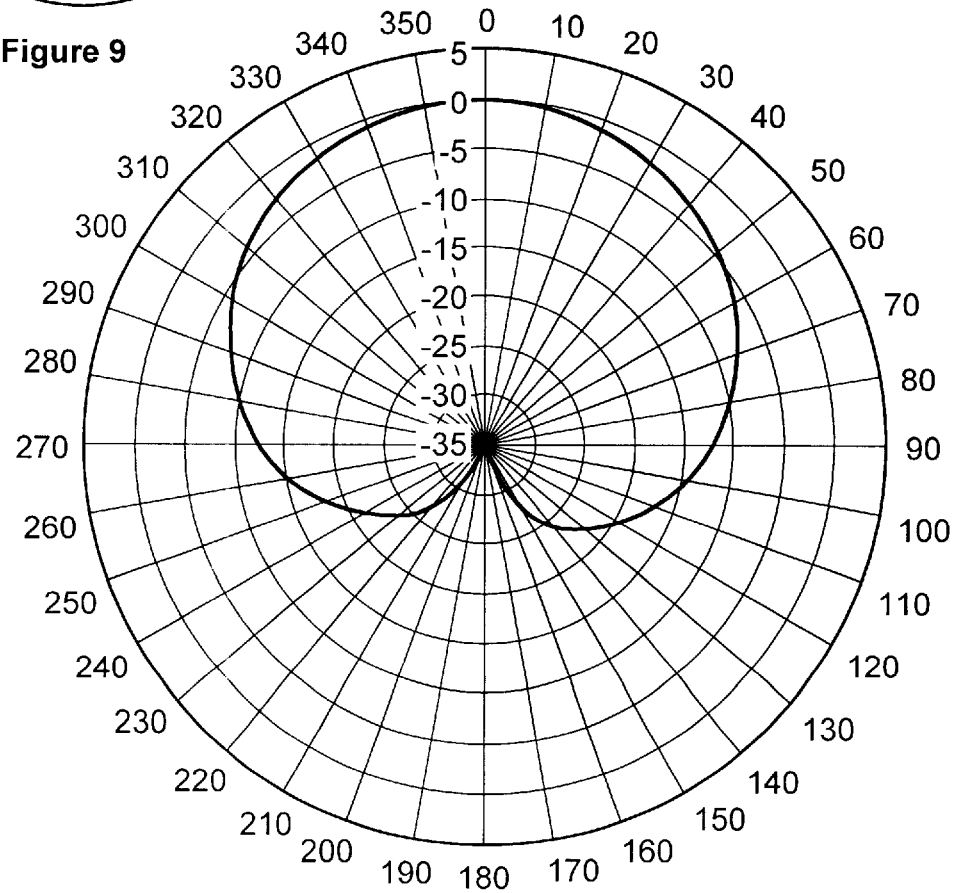
FIG. 11 is graph showing the azimuth radiation pattern from one segment of the pole antenna of the invention.

Each antenna segment in the pole antenna of the present invention provides an azimuth radiation pattern similar to the one shown in FIG. 11, which shows radiated power at all azimuth angles, relative to the power in the 0° direction. The maximum power of a minor lobe in the 180° direction is −35.15 dB (decibels), i.e., 35.15 dB below the power in the 0° direction. A figure of merit for antenna beam patterns is the 3 dB beamwidth or half-power beamwidth, which is the angular width of the beam over which the power falls off by only one half, or 3 dB. In this instance, the 3 dB beamwidth is 81.65° or ±40.82°. When the radiation patterns of all three segments are combined, the antenna provides practically uniform radiation in all azimuth directions. The elevation radiation pattern provides a beam with a half-power beamwidth of approximately 14°, and a beam tilt that can be adjusted by design, as needed for any specific antenna site.

The overall height of the pole antenna mounted in its cover and on its cylindrical base is approximately 82 inches (208 cm). The outside diameter is approximately 16 inches (40.6 cm) and the antenna is usually mounted atop a conventional pole of the same diameter, which may also perform some other function, such as street lighting. The mounted pole antenna is capable of withstanding extremes of weather, including winds up to 155 mph (249 km/h), subzero temperatures, and 100-percent humidity. Because the pole's exterior is smooth and uncluttered, it does not attract birds or other animals and is easy to maintain, with a service life of ten years or more.

Because the antenna uses conventional snap fasteners that are common in the computer industry, assembly is easy and convenient. Further, the use of conventional printed circuit boards and plate metal for the ground plane structure 26 and the antenna patches 16, renders the entire antenna structure relatively low in cost.

It will be appreciated from the foregoing that the present invention represents a significant advance in the field of RF antennas. In particular, the pole antenna of the present invention meets stringent electrical design requirements for communication system antennas, including good beam shape in both azimuth and elevation, polarization diversity gain to reduce bit-error rates, and minimal intermodulation effects. In addition the pole antenna of the invention fulfils environmental goals because of its smooth cylindrical exterior, which reduces RF exposure to wildlife and provides a more environmentally appealing appearance. It will be understood, however, that although the invention has been described in detail for purposes of illustration, various modifications may be made without departing from the spirit and scope of the invention. For example, the invention is not intended to be limited to any particular frequency range or dimensional limitations, or to a structure of three antenna segments. Antennas with three segments spaced at 120° are common in the cellular telephone industry, but omnidirectional coverage could also be obtained using, for example, an array of four or more segments. For these and other reasons, the invention should not be limited except as by the appended claims.

What is claimed is:

1. A radio-frequency (RF) pole antenna with multiple arrays, the antenna comprising:

a ground plane structure having a plurality (n) of structurally and electrically connected facets directed in uniformly spaced angular directions;

a plurality (n) of antenna feed printed circuit boards, each of which is attached to but spaced apart from one of the ground plane facets, wherein each antenna feed printed circuit board has two feed points and two symmetrical circuit paths for feeding RF signals of different polarizations, and wherein each of the circuit paths has divergent branches leading to a plurality (m) of antenna patch drive segments;

a plurality (n) of arrays of antenna patches, each array having a plurality (m) of antenna patches distributed along one of the antenna feed printed circuit boards and mounted to provide electromagnetic coupling between each antenna patch and a pair of antenna patch drive segments, one from each circuit path in the antenna feed printed circuit board, wherein each antenna patch is coupled simultaneously to an associated pair of antenna feed patch drive segments, and wherein each antenna patch includes a drive element electromagnetically coupled to its associated pair of antenna feed patch drive segments, and at least one parasitic element mounted in a spaced relationship with the drive element;

a plurality (n) of pairs of RF feed connectors, each pair providing electromagnetic coupling with respective feed points on one of the antenna feed printed circuit boards, and providing connection to RF transmitting and receiving circuitry that employ the pole antenna; and a cylindrical cover positioned to conceal the ground plane structure, the antenna feed printed circuit boards, the antenna patches and the RF feed antennas, wherein the entire antenna is enclosed in the cylindrical cover, and whereby the enclosed antenna is highly suited for mounting on a support pole of similar diameter to that of the cover.

2. An RF pole antenna as defined in claim 1, wherein:

each antenna array formed by the ground plane structure, one of the antenna feed printed circuit boards, one of the arrays of antenna patches, and one of the pairs of RF feed connectors, has metal-to-metal connection only in the pair of RF feed connectors, whereby intermodulation effects on antenna performance are minimized.

3. An RF pole antenna as defined in claim 2, wherein:

the ground plane structure is assembled using a dimple welding process that further reduces the likelihood of adverse intermodulation effects.

4. An RF pole antenna as defined in claim 1, wherein:

the number (n) of antenna arrays and ground plane facets is three.

5. An RF pole antenna as defined in claim 1, wherein:

each antenna patch includes two parasitic elements, including a first parasitic element mounted in a parallel spaced relationship with the drive element, and a second parasitic element mounted in a parallel spaced relationship with the first parasitic element.

6. An RF pole antenna as defined in claim 5, wherein:

the drive element in each antenna patch is a flat plate of generally octagonal shape;

the first parasitic element in each antenna patch is a flat plate of irregular shape having four extending arms and diagonally slanting edges between the arms; and the second parasitic element in each antenna patch is a flat plate having an approximately square shape with diagonally cutoff corners.

7. An RF pole antenna as defined in claim 1, wherein each array of antenna patches is driven simultaneously in two different polarization modes to provide polarization diversity gain.

8. An RF pole antenna as defined in claim 7, wherein each array of antenna patches is driven simultaneously in linear polarization modes at +45° and −45° with respect to a vertical axis of the pole antenna.

9. A radio-frequency (RF) pole antenna with multiple arrays, the antenna comprising:

a ground plane structure having a plurality (n) of structurally and electrically connected facets directed in uniformly spaced angular directions;

a plurality (n) of antenna feed printed circuit boards, each of which is attached to but spaced apart from one of the ground plane facets, wherein each antenna feed printed circuit board has two feed points and two symmetrical circuit paths for feeding RF signals of different polarizations, and wherein each of the circuit paths has divergent branches leading to a plurality (m) of antenna patch drive segments;

a plurality (n) of arrays of antenna patches, each array having a plurality (m) of antenna patches distributed along one of the antenna feed printed circuit boards and mounted to provide electromagnetic coupling between each antenna patch and a pair of antenna patch drive segments, one from each circuit path in the antenna feed printed circuit board, wherein each antenna patch is coupled simultaneously to an associated pair of antenna feed patch drive segments, and wherein each antenna patch includes a drive element electromagnetically coupled to its associated pair of antenna feed patch drive segments, and two additional parasitic elements mounted one over the other in an overlapping, spaced relationship with the drive element;

a plurality (n) of pairs of RF feed connectors, each pair providing electromagnetic coupling with respective feed points on one of the antenna feed printed circuit boards, and providing connection to RF transmitting and receiving circuitry that employ the pole antenna; and a cylindrical cover positioned to conceal the ground plane structure, the antenna feed printed circuit boards, the antenna patches and the RF feed antennas, wherein the entire antenna is enclosed in the cylindrical cover, and whereby the enclosed antenna is highly suited for mounting on a support pole of similar diameter to that of the cover;

wherein each antenna array formed by the ground plane structure, one of the antenna feed printed circuit boards, one of the arrays of antenna patches, and one of the pairs of RF feed connectors, has metal-to-metal connection only in the pair of RF feed connectors, whereby intermodulation effects on antenna performance are minimized, and wherein the ground plane structure is assembled using a dimple welding process that further reduces the likelihood of adverse intermodulation effects;

and wherein each array of antenna patches is driven simultaneously in linear polarization modes at +45° and −45° with respect to a vertical axis of the pole antenna, for polarization diversity gain and improved reliability in transmitting digital data.

10. A radio-frequency (RF) pole antenna with three arrays, the antenna comprising:

a ground plane structure having three structurally and electrically connected facets directed in uniformly spaced angular directions;

three antenna feed printed circuit boards, each of which is attached to but spaced apart from one of the ground plane facets, wherein each antenna feed printed circuit board has two feed points and two symmetrical circuit paths for feeding RF signals of different polarizations, and wherein each of the circuit paths has divergent branches leading to a plurality (m) of antenna patch drive segments;

three arrays of antenna patches, each array having a plurality (m) of antenna patches distributed along one of the antenna feed printed circuit boards and mounted to provide electromagnetic coupling between each antenna patch and a pair of antenna patch drive segments, one from each circuit path in the antenna feed printed circuit board, wherein each antenna patch is coupled simultaneously to an associated pair of antenna feed patch drive segments, and wherein each antenna patch includes a drive element electromagnetically coupled to its associated pair of antenna feed patch drive segments, and two additional parasitic elements mounted one over the other in an overlapping, spaced relationship with the drive element;

three pairs of RF feed connectors, each pair providing electromagnetic coupling with respective feed points on one of the antenna feed printed circuit boards, and providing connection to RF transmitting and receiving circuitry that employ the pole antenna; and a cylindrical cover positioned to conceal the ground plane structure, the antenna feed printed circuit boards, the antenna patches and the RF feed antennas, wherein the entire antenna is enclosed in the cylindrical cover, and whereby the enclosed antenna is highly suited for mounting on a support pole of similar diameter to that of the cover;

wherein each antenna array formed by the ground plane structure, one of the antenna feed printed circuit boards, one of the arrays of antenna patches, and one of the pairs of RF feed connectors, has metal-to-metal connection only in the pair of RF feed connectors, whereby intermodulation effects on antenna performance are minimized, and wherein the ground plane structure is assembled using a dimple welding process that further reduces the likelihood of adverse intermodulation effects;

and wherein each array of antenna patches is driven simultaneously in linear polarization modes at +45° and 45° with respect to a vertical axis of the pole antenna, for polarization diversity gain and improved reliability in transmitting digital data.

* * * * *